US007364055B2

(12) United States Patent
Yquel et al.

(10) Patent No.: US 7,364,055 B2
(45) Date of Patent: Apr. 29, 2008

(54) VARIABLE-FLOW TILT VALVE AND CONTAINER FITTED WITH SUCH A VALVE

(75) Inventors: Jean-Pierre Yquel, Colombes (FR); Guiseppe Dalsant, Baselga di Pineitalie (IT)

(73) Assignee: L'Oreal, Paris (FR)

( * ) Notice: Subject to any disclaimer, the term of this patent is extended or adjusted under 35 U.S.C. 154(b) by 517 days.

(21) Appl. No.: 10/663,756

(22) Filed: Sep. 17, 2003

(65) Prior Publication Data

US 2004/0124217 A1 Jul. 1, 2004

Related U.S. Application Data

(60) Provisional application No. 60/419,528, filed on Oct. 21, 2002.

(30) Foreign Application Priority Data

Sep. 18, 2002 (FR) ..... 02 11559

(51) Int. Cl.
*B65D 83/00* (2006.01)

(52) U.S. Cl. ..... 222/402.21

(58) Field of Classification Search ..... 222/402.21–402.22, 402.24
See application file for complete search history.

(56) References Cited

U.S. PATENT DOCUMENTS 3,096,003 A * 7/1963 Nesin ..... 222/402.16
3,195,569 A 7/1965 Seaquist
3,292,827 A * 12/1966 Frangos ..... 222/402.24
3,344,961 A * 10/1967 Graham ..... 222/402.22
3,795,350 A 3/1974 Shay
4,139,128 A 2/1979 Ewald
4,416,398 A 11/1983 Knickerbocker
6,296,155 B1 * 10/2001 Smith ..... 222/402.1

FOREIGN PATENT DOCUMENTS

FR 2725182 4/1996

* cited by examiner

*Primary Examiner*—Philippe Derakshani
(74) *Attorney, Agent, or Firm*—Oblon, Spivak, McClelland, Maier & Neustadt, P.C.

(57) ABSTRACT

A tilting valve for dispensing a product from a pressurized container includes an opening/closing element with at least two inlet apertures. The opening/closing element is capable, in response to a force transmitted to the opening/closing element laterally to a longitudinal axis of the tilting valve, of moving from a closed position to a first open position in which the product under pressure is dispensed at a first flow rate. The opening/closing element is further capable, in response to a force transmitted to the opening/closing element parallel to the longitudinal axis, of moving from the closed position to a second open position in which the product is dispensed at a second flow rate different from the first flow rate.

48 Claims, 5 Drawing Sheets

VARIABLE-FLOW TILT VALVE AND CONTAINER FITTED WITH SUCH A VALVE

CROSS-REFERENCE TO RELATED APPLICATIONS

This document claims priority to French Application No. 02 11559, filed Sep. 18, 2002 and U.S. Provisional Application No. 60/419,528, filed Oct. 21, 2002, the entire content of both of which is hereby incorporated by reference.

FIELD OF THE INVENTION

The invention disclosed relates to a valve for a pressurized container. Such valves are used for example in cosmetics to dispense hair products (lacquers, sprays, etc.), personal hygiene products, make-up products, or sunscreen products.

BACKGROUND OF THE INVENTION

Discussion of Background

In a common configuration, valves for pressurized containers include a valve body incorporating an opening/closing element in the form of a valve stem, part of which emerges outside the valve body. The valve stem is capable of sliding in a leaktight manner in engagement with a sealing element in the form of an annular seal.

The valve stem is traversed by an axial channel one extremity of which emerges axially outside the valve body. The valve stem is designed to communicate with a passage traversing a valve actuating element incorporating at least one outlet aperture. The other extremity of the channel emerges radially via an inlet aperture or several inlet apertures arranged in the same axial position.

When the valve is in the closed position, the inlet aperture (s) is (are) closed against the sealing element. In response to an operating action, the valve moves axially downward, and the inlet aperture(s) in the valve stem is (are) placed in communication with the pressurized product inside the valve body. The product is then carried, via the valve stem and the passage traversing the actuating element, to the dispensing aperture. In the case of a valve with several inlet apertures, these are simultaneously placed in communication with the valve body.

When the operating action ceases, a spring housed inside the valve body returns the valve stem to the closed position. The dispensing of product is interrupted.

As well as being actuated in response to an axial movement, certain valves can be actuated in response to a force exerted laterally on the valve stem. These valves are referred to as "tilt" valves. In certain so-called "female" valves, the opening/closing element does not emerge outside the valve body. In this case, a portion of the actuating element is engaged inside the valve body and causes the valve to open or close.

A valve according to a different configuration is described, for example, in patent FR 2 725 182. In this document, the valve body is traversed by a purge aperture for the dispensing of a propellant gas in conjunction with the product or separately from it.

In all of these known valves, the operating action produces a movement of the opening/closing element, and its passage from a closed position to an open position in which the product is dispensed at a determinate and single flow rate.

In the first type of valve, the cross-section of the inlet aperture(s) and/or the number of inlet apertures determines the exit flow rate. For a valve of the type as described in document FR 2 725 182, referred to above, the depth and/or the width and/or the number of grooves made on the inner surface of the valve body determines the exit flow rate.

Thus, when the hair product is in the form of a lacquer, a container fitted with a valve allowing a first flow rate is used. When the product is to be atomized in the form of a spray, another container fitted with another valve allowing a second flow rate, higher than the first, is used. Two separate devices are therefore required when the user wishes to have the option of choosing between two different dispensing modes of the same product.

Variable-flow valves are described in documents U.S. Pat. Nos. 3,292,827, 3,195,569 and 6,296,155. By virtue of their configuration, the two positions with different flow rates are close to each other. In particular, the two flow rates are obtained by transmitting a force to the valve in the same direction, more precisely by moving the valve stem downward to a greater or lesser degree.

U.S. Pat. No. 4,139,128 describes a variable-flow tilt valve. This valve includes a valve stem traversed by a channel emerging, on one hand, at an outlet aperture and, on the other hand, at a product inlet passage defined between two parts of the valve stem. When the valve stem is moved axially downward, this passage is placed in communication with the pressurized product inside the valve body. When the valve stem is tilted, the two parts of the valve stem defining the product inlet passage move apart so as to enlarge the passage.

SUMMARY OF THE INVENTION

One of the objects of the invention is to provide a valve capable of dispensing a product at different flow rates, according to the spray characteristics desired, making a distinction between the actuating movements allowing the product to be dispensed at different flow rates.

Another object of the invention is to provide a device that is simple and economical to produce.

Further objects of the invention will become apparent in the detailed description which follows.

According to one embodiment of the invention, these objects are achieved with a tilt-type valve configured to dispense a product contained in a pressurized container. The valve includes a lengthwise axis X and incorporates an opening/closing element with at least two inlet apertures. The opening/closing element is capable, in response to a force transmitted to the opening/closing element laterally to the axis X, of moving from a closed position to a first open position in which the product under pressure is dispensed at a first flow rate and which, in response to a force transmitted to the opening/closing element parallel to the axis X, is capable of moving from the closed position to a second open position in which the product is dispensed at a second flow rate different from the first.

The two open positions permit two different dispensing flow rates, each being obtained in normal conditions of use by a manual action, for example using the finger, and capable of being maintained for as long as desired. Thus, in the case of a hairstyling product for example, in an initial open position, the product is dispensed at a relatively low flow rate, in the form of a lacquer. In a second opening position, the product is dispensed at a higher flow rate, in the form of a spray. The same device can then be used for both dispensing modes.

The movement to actuate the opening/closing element to dispense the product at the first flow rate is relatively different from that used to dispense the product at the second flow rate. In effect, when the opening/closing element is directly accessible by the user, the force transmitted to the opening/closing element is the force exerted by the user directly on the opening/closing element. In one embodiment, the first flow rate is obtained by tilting the opening/closing element, while the second flow rate is obtained by depressing it, thereby allowing the user to readily differentiate the two flow rates. In the case where the opening/closing element is surmounted by an actuating element, for example a pushbutton, the force transmitted to the opening/closing element is that transmitted by the pushbutton in response to the force exerted by the user on the pushbutton.

The two flow rates can also be readily identified by identifying, for example, two distinct surfaces on the pushbutton. A first surface can be configured to transmit a force to the opening/closing element laterally to the axis X, and a second surface can be configured to transmit a force to the opening/closing element parallel to the axis X. In addition, two distinct inlet apertures can clearly differentiate the two flow rates.

The valve can be in communication with the product via an immersion tube, the product being in this case propelled by means of a liquefied or compressed gas. Alternatively, the product can be contained inside a flexible-walled pocket with the propellant gas on the outside. Other pressurizing mechanisms are possible. According to one embodiment of the invention, the opening/closing element can include a valve stem of which a portion emerges outside a valve body. The valve stem is traversed by an axial channel emerging, at or near one end, outside the valve body via an outlet aperture and, at or near the other end, via at least two inlet apertures which, in the closed position, are isolated from the valve body.

The valve can include a sealing element, for example in the form of an annular seal placed inside the valve body. The valve stem can include an annular portion placed inside the valve body. The annular portion can incorporate a lip capable, in the closed position, of bearing against the sealing element so as to define in conjunction with the sealing element an annular space isolated from the valve body, with the first inlet aperture emerging inside the annular space.

At least one second inlet aperture emerges laterally against the sealing element, in the closed position. The first and second inlet apertures can be of identical cross-section, or of dissimilar cross-section.

From a practical point of view, the flow rate is not necessarily a direct function of the number and size of the apertures. In effect, in the case where the product enters the valve stem via at least two separate apertures, the flows of product via the different apertures may interfere with each other as a function of the relative position of the apertures, so that the resultant flow rate can be different from the sum of the flow rates particular to each aperture taken independently.

The first and second inlet apertures can be at different angular positions. This configuration has the effect of reducing transient phenomena between the flows corresponding to each of the open positions.

According to another aspect of the invention, a device is provided for the packaging and dispensing of a product, for example a cosmetic product. The device can include a pressurized container holding the product to be dispensed, and can be fitted with a valve according to the present invention.

The product can be pressurized with a compressed or liquefied gas. The propellant gas can be in contact with the product or separated from it by a piston or flexible pocket inside which the product is held.

The device can also include an element to actuate the valve and dispense the product under pressure via at least one dispensing aperture located, for example, inside a nozzle, such as a swirl-effect nozzle. The actuating element can include two distinct bearing surfaces for actuation of the valve. A first bearing surface can be configured so that the opening/closing element moves axially and a second bearing surface can be configured so that the opening/closing element moves laterally. For example, the first bearing surface can pass through a plane effectively perpendicular to the axis X. The second bearing surface can pass through a plane parallel to the axis X, or can pass through a plane effectively perpendicular to the axis X and be formed at a distance offset from the axis X so that the second bearing portion does not intersect the axis X.

Advantageously, the device according to the invention can be used for the packaging and dispensing under pressure of a cosmetic product, for example a hair product, a personal hygiene product, a make-up product, a skincare product, or a sunscreen product.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
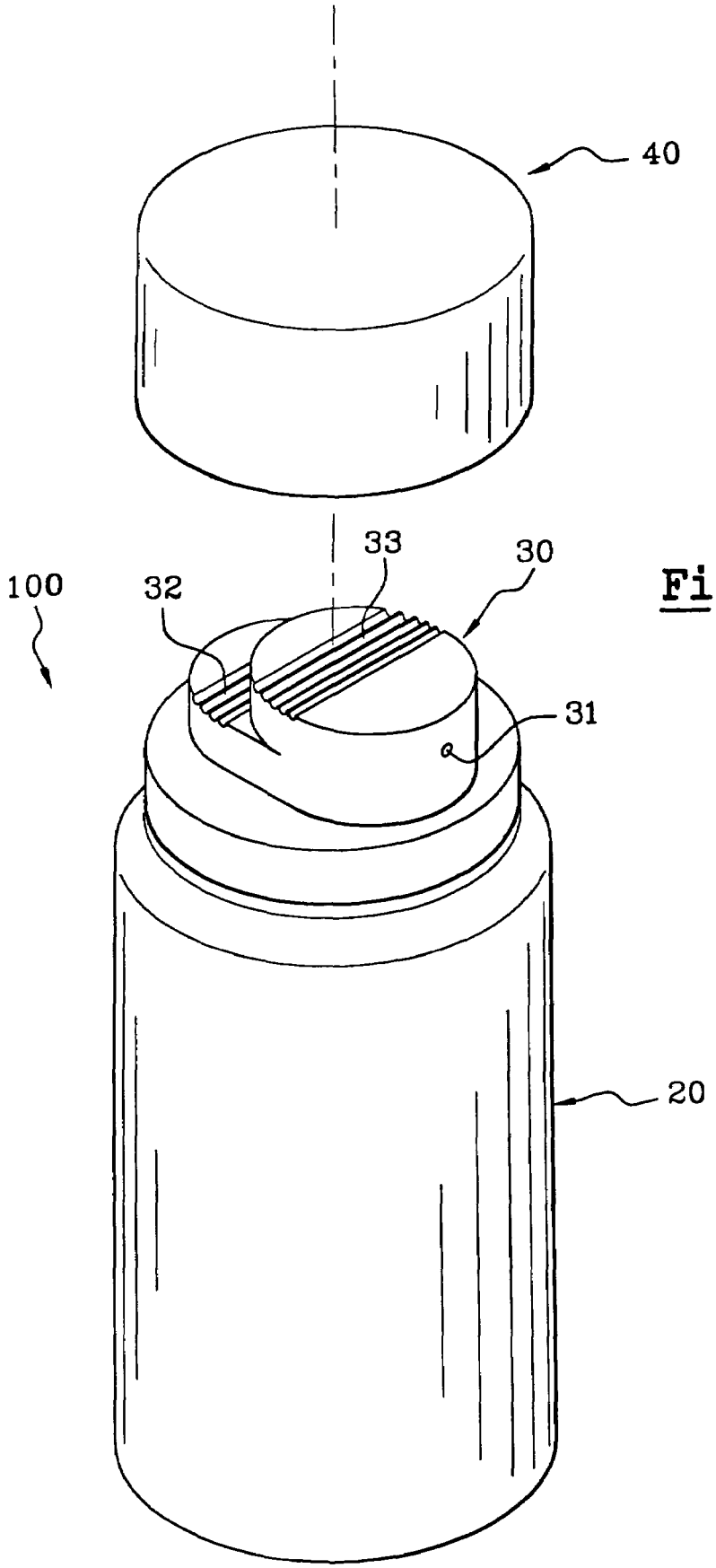
FIG. 1 shows a general view of a packaging and dispensing device according to one embodiment of the invention.
Figure 2:
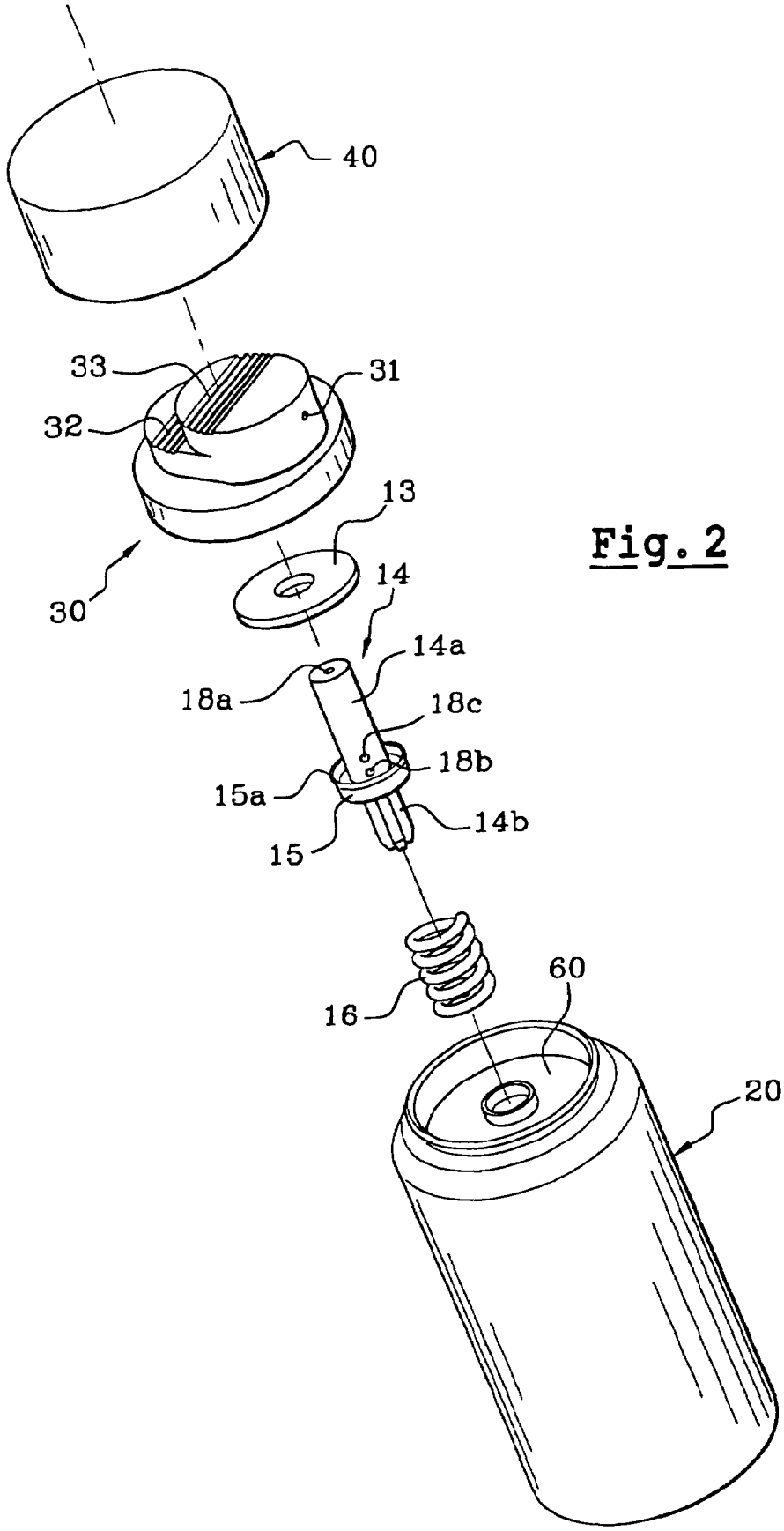
FIG. 2 shows an exploded view of the device illustrated in FIG. 1.

The device 100 illustrated overall in FIG. 1 includes a cylindrical container 20, for example made of aluminum or tinplate, surmounted by a head 30 for the actuation of a valve 10 (which will be described in detail below) and for the dispensing of a composition, for example a hair product, via a dispensing aperture 31. The dispensing head 30 includes two bearing surfaces 32 and 33 configured to actuate the valve. A removable cap 40 covers the dispensing head 30.

Figure 3A:
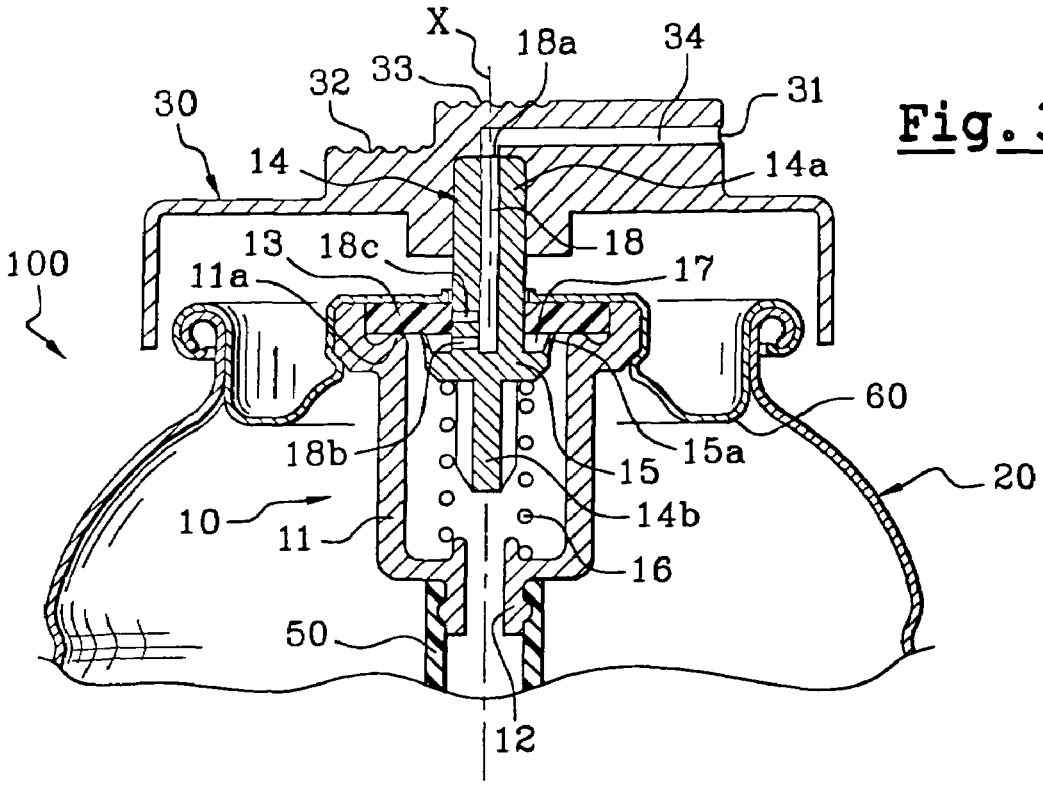
FIGS. 3A to 3C show partial cross-sections of the device illustrated in FIG. 1 in different positions.
Figure 3B:
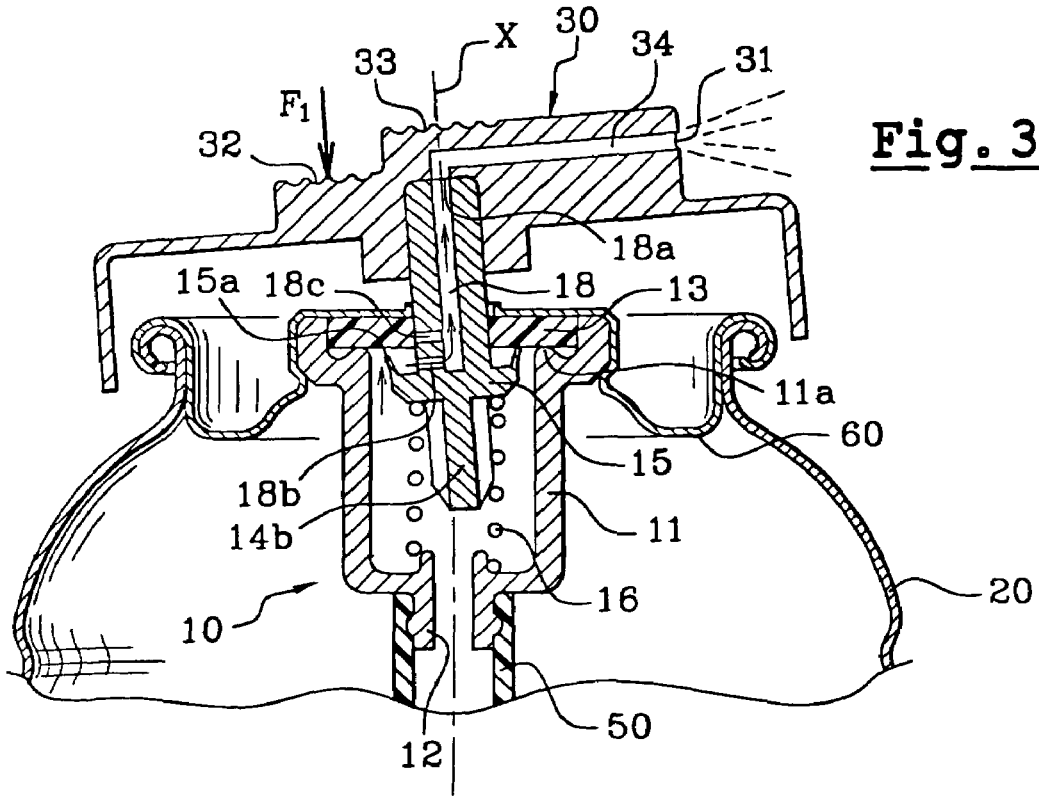
Figure 3C:
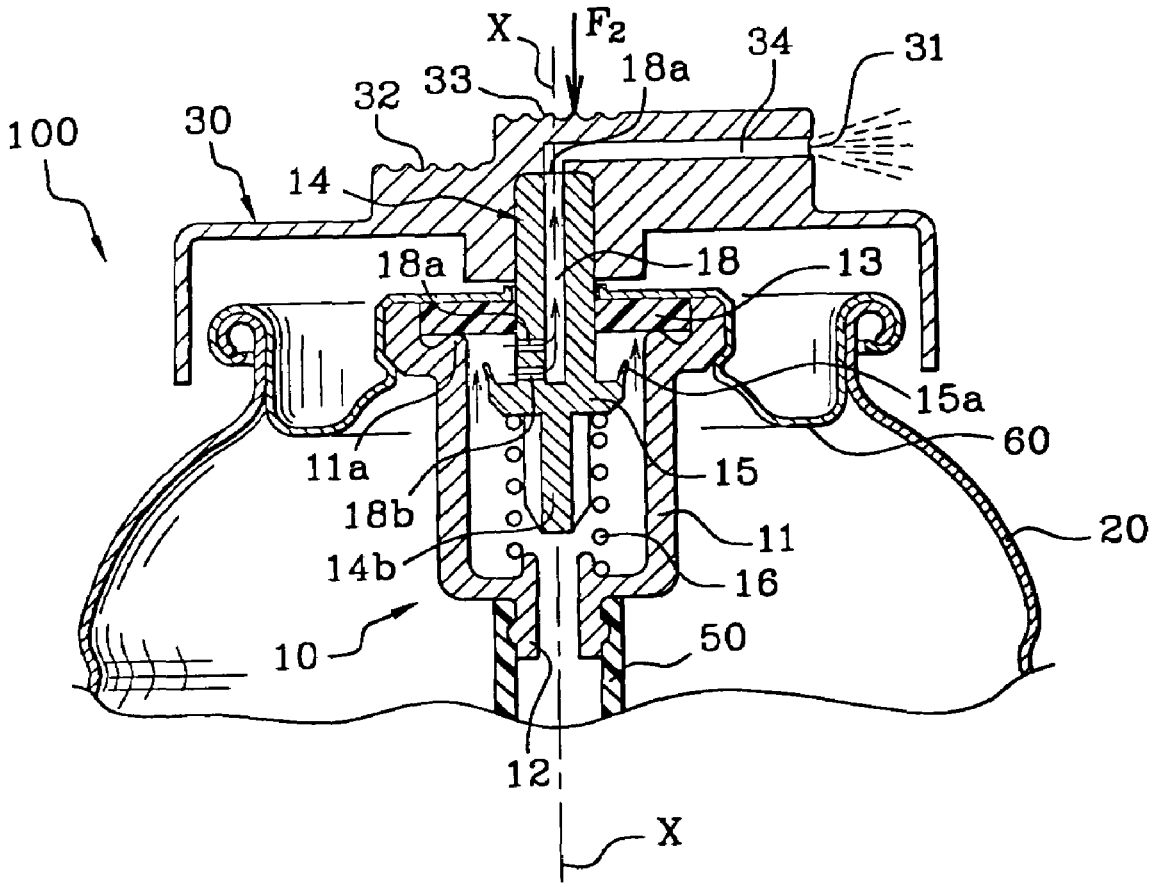

As can be seen in greater detail in FIGS. 3A to 3C, the valve 10 is mounted in a collar 60 rolled onto a flanged edge of the aluminum container 20. The latter is shown only partially. The valve 10, of longitudinal axis X, includes a cylindrical valve body 11 one end of which terminates in an axial conduit 12 onto which an immersion tube 50 is press fitted. The other end of the valve body 11 is closed by the valve supporting collar 60. A seal 13 provides leaktight closure. By way of example, the seal 13 can be annular and can be approximately 1 mm in thickness. An annular crown 11*a*, formed inside the valve body 11 in proximity to the collar 60, forms a leaktight contact with the inner surface of the seal 13, thereby simultaneously holding the latter in position and providing the requisite leaktightness. A valve stem 14, of which a portion 14*a* emerges outside the valve body 11, slides axially inside the annular seal 13.

In this embodiment, a part 14*b* of the valve stem 14 is located inside the valve body 11, and includes an annular portion 15 of which the periphery incorporates a lip 15*a*. A spring 16, in the absence of force exerted on the valve stem, holds the free end of the annular lip 15*a* tightly against the seal 13 such that an annular space 17 is defined by the annular portion 15, the lip 15*a* and the annular seal 13.

The valve stem 14 is traversed axially by a channel 18 of which one extremity emerges outside the valve body via an axial opening 18*a*. The channel 18 emerges radially in proximity to its other end via two openings 18*b* and 18*c*. A first opening 18*b* emerges into the annular space 17 in the valve closed position (FIG. 3A). A second opening 18*c* bears tightly against the inner edge of the annular seal 13 in the valve closed position. According to the example illustrated, openings 18*b* and 18*c* are of identical cross-section and occupy more or less the same angular position. The diameter of openings 18*b* and 18*c* can be for example of the order of 0.2 to 0.6 mm. They are disposed axially, for example approximately 1.5 mm apart. However, it is clear that the two openings can have different cross-sections and/or angular spacings.

As can be seen in FIGS. 3B and 3C, a dispensing head 30 in the form of a pushbutton is press fitted onto the emergent part 14*a* of the valve stem 14. The dispensing head 30 is traversed by a passage 34 of which one extremity is in communication with the channel 18 in the valve stem. The other end of the passage 34 leads to a dispensing aperture 31, defined for example by a swirl channel nozzle (not shown in detail).

The dispensing head includes a first bearing surface 32 formed at a distance from the axis X and which allows the valve to be actuated by a tilting movement. The dispensing head includes a second bearing surface 33 passing through the axis X of the valve stem and preferably perpendicular to this axis X, which allows the valve to be actuated by a downward axial movement.

By exerting a force F1 on the surface 32 of the dispensing head (FIG. 3B), a lateral force is transmitted to the valve stem 14 such that it is tilted relative to the axis X. The annular lip 15*a* moves away from the seal 13, following a certain angular path, thereby establishing communication between the inside of the valve body and the annular space 17 and therefore between the inside of the valve body and the inside of the stem 14 via the opening 18*b*. The opening 18*c* remains closed against the seal 13. The product contained in the valve body enters the channel 18 in the valve stem 14 via opening 18*b* only. It travels through the passage 34 in the dispensing head 30 and exits in the form of a cloud of fine droplets via aperture 31 at a first flow rate, for example, approximately 0.4 g/s.

By exerting a force F2 on the surface 33 of the dispensing head (FIG. 3C), the valve stem moves axially downward by a distance such that the opening 18*c* is no longer aligned with the annular seal 13. In addition, the annular lip 15*a* disengages from the seal 13 around its entire circumference. The product enters the channel 18 in the valve stem via the two openings 18*b* and 18*c*. It is then dispensed via the dispensing aperture 31, for example in the form of a spray at a second flow rate significantly higher than that in FIG. 3B, for example at approximately 1.0 g/s.

From one or the other actuation positions of FIG. 3B or 3C, by releasing the pressure on the dispensing head, the spring 16 causes the valve stem 14 to revert to its position in FIG. 3A. Dispensing of product is interrupted.

Figure 4:
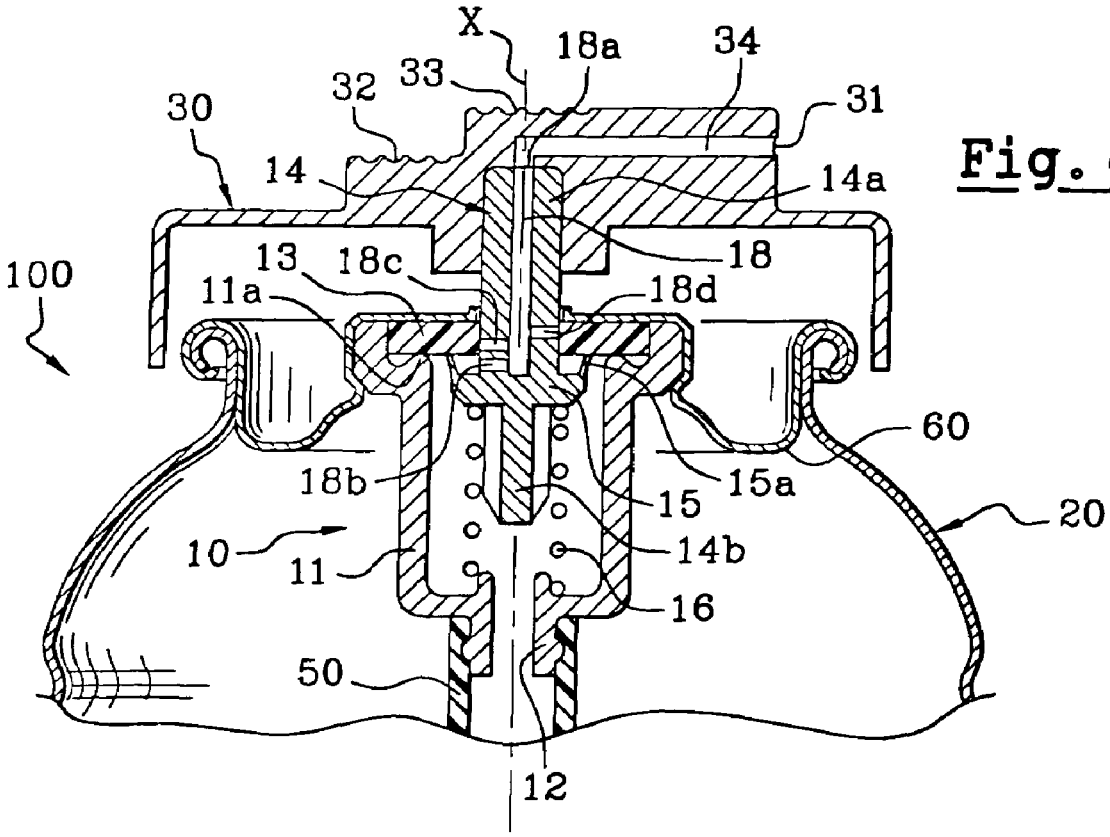
FIG. 4 shows a partial cross-section of a variant of the device illustrated in FIGS. 1 to 3C.

According to a variant illustrated in FIG. 4, the channel 18 in the valve stem 14 emerges radially via a third opening 18*d* placed at an angular offset relative to opening 18*c*. The third opening 18*d* also engages in a leaktight manner against the inner edge of the annular seal 13 in the valve closed position. The valve 10 can be identical in all other respects to that in the previous embodiment.

According to this variant, by exerting a force on the surface 32 of the dispensing head, a lateral force is transmitted to the valve stem 14 such that it is tilted relative to the axis X. As before, the annular lip 15*a* disengages from the seal 13 thereby establishing communication between the inside of the valve body and the inside of the stem 14 via opening 18*b*. Openings 18*c* and 18*d* remain closed against the seal 13. The product enters the channel 18 in the valve stem 14 via opening 18*b* only, and is dispensed via the aperture 31 at a first flow rate.

By exerting a moderate force axially on the surface 33 of the dispensing head, the valve stem moves downward by a distance such that opening 18*c* is no longer aligned with the seal 13, while opening 18*d* remains closed against the seal 13. The product contained in the valve body enters the channel 18 in the valve stem 14 via openings 18*b* and 18*c* and is dispensed via the aperture 31 at a second flow rate.

By exerting a slightly greater axial force on the surface 33 of the dispensing head, the valve moves downward by a greater distance such that opening 18*d* leaves its position of leaktight engagement with the seal 13. The product then enters the channel 18 in the valve stem via the three openings 18*b*, 18*c* and 18*d*. It is then dispensed via the dispensing aperture 31 at a rate significantly higher than the second flow rate.

Figure 5:
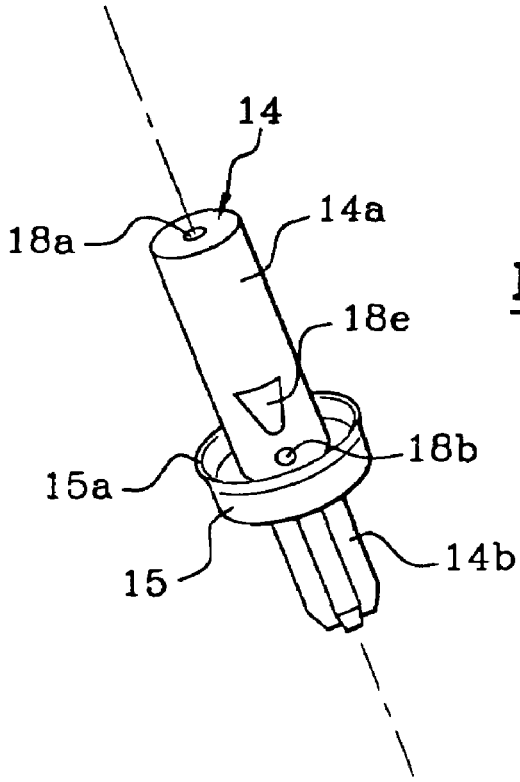
FIG. 5 shows a variant of the opening/closing element of the device according to the invention.

By replacing the two openings 18*c* and 18*d*, it is possible to use an opening 18*e*, for example of triangular section, as illustrated in FIG. 5. The width of the opening 18*e* decreases progressively in the direction towards the bottom of the container. This opening 18*e* also engages in a leaktight manner against the inner edge of the annular seal 13 in the valve closed position.

According to this variant, by exerting a moderate axial force on the bearing surface 33 of the dispensing head 30, the valve stem 14 moves downward by a distance such that only a narrow portion of the opening 18*e* is disengaged from the annular seal 13. The upper part of the opening 18*e* (i.e. its wider portion) remains closed against the seal 13. The product contained in the valve body enters the channel 18 in the valve stem 14 via the lower part of opening 18*e* and also via opening 18*b*. It enters the passage 34 in the dispensing head 30 and exits in the form of a cloud of fine droplets via opening 31. The dispensed flow rate is relatively low.

The greater the force exerted on the dispensing head 30 the higher the flow rate, until a position is reached where the opening 18*e* is fully disengaged from the seal 13. In this position, the product is dispensed at a rate significantly greater than the previous flow rate. Alternatively, the opening 18*e* may be of oblong section and effectively of constant width over its full height. In this alternative, for an identical height of the opening 118*e*, the difference in flow rate between the two positions is smaller than in the case of an opening of triangular section. Other shapes for the second inlet opening 18*e* are possible, preferably having an elongated dimension along the longitudinal axis X of the stem 14.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A tilting valve for dispensing a product from a pressurized container, comprising:

an opening/closing element with at least two inlet apertures, the opening/closing element being capable, in response to a force transmitted to the opening/closing element laterally to a longitudinal axis of said tilting valve, of moving from a closed position to a first open position in which the product under pressure is dispensed at a first flow rate and, in response to a force transmitted to the opening/closing element parallel to the longitudinal axis, of moving from the closed position to a second open position in which the product is dispensed at a second flow rate different from the first flow rate.

2. The valve according to claim 1, further comprising a valve body, and wherein the opening/closing element includes a valve stem with a portion which emerges outside the valve body, said valve stem being traversed by an axial channel emerging outside the valve body via an outlet aperture and via at least two inlet apertures which, in the closed position, are isolated from the valve body.

3. The valve according to claim 2, further comprising a sealing element, and wherein the valve stem includes an annular portion placed inside the valve body, said annular portion incorporating a lip capable, in the closed position, of bearing against the sealing element so as to define in conjunction with said sealing element an annular space isolated from the valve body, with a first inlet aperture emerging inside the annular space.

4. The valve according to claim 3, wherein at least one second inlet aperture emerges laterally against said sealing element, in the closed position.

5. The valve according to claim 2, wherein said at least two inlet apertures include a first and a second inlet apertures with different angular positions.

6. The valve according to claim 2, wherein said at least two inlet apertures include a first and a second inlet apertures with identical cross-sections.

7. The valve according to claim 2, wherein said at least two inlet apertures include a first and a second inlet apertures with different cross-sections.

8. A device for packaging and dispensing a product, comprising:

a pressurized container holding the product to be dispensed, and a tilt valve according to claim 1 coupled to said pressurized container.

9. A device according to claim 8, further comprising an actuating element to actuate the tilt valve and dispense the product under pressure via at least one dispensing aperture.

10. A device according to claim 9, wherein the actuating element includes two distinct bearing surfaces, a first bearing surface for moving the opening/closing element laterally and a second bearing surface for moving the opening/closing element axially.

11. The device according to claim 10, wherein said product is one of a hair product, a personal hygiene product, a make-up product, a skincare product, and a sunscreen product.

12. The valve according to claim 3, wherein said sealing element is an annular seal placed inside said valve body.

13. The device according to claim 1, wherein said product is a cosmetic product.

14. The device according to claim 8, wherein said product is a cosmetic product.

15. The device according to claim 9, wherein said at least one dispensing aperture is located inside a nozzle.

16. The device according to claim 15, wherein said nozzle is a swirl nozzle.

17. The valve according to claim 1, wherein said opening/closing element is configured to move from said closed position to said first open position in response only to said force transmitted to the opening/closing element laterally to said longitudinal axis of said tilting valve.

18. The valve according to claim 1, wherein said opening/closing element is configured to move from said closed position to said first open position in response to said force transmitted to the opening/closing element laterally to said longitudinal axis of said tilting valve without any application of an axial force transmitted to the opening/closing element along the longitudinal axis.

19. The valve according to claim 17, wherein said opening/closing element is configured to move from said first open position to said second open position in response only to said force transmitted to the opening/closing element parallel to the longitudinal axis.

20. The valve according to claim 18, wherein said opening/closing element is configured to move from said first open position to said second open position in response to said force transmitted to the opening/closing element parallel to said longitudinal axis of said tilting valve without any application of a force transmitted to the opening/closing element laterally the longitudinal axis.

21. The valve according to claim 3, wherein the lip is configured to disengage from the sealing element and follow an angular path in response to said force transmitted to the opening/closing element laterally to said longitudinal axis of said tilting valve.

22. The valve according to claim 3, wherein the valve stem is configured to follow an angular path in response to said force transmitted to the opening/closing element laterally to said longitudinal axis of said tilting valve.

23. The valve according to claim 3, wherein the valve body does not include a compressible member, separate from a return spring, configured to indicate different flow rates.

24. A valve for dispensing a product, comprising:

a body;

a sealing portion coupled to said body;

a stem coupled to said sealing portion, said stem being radially movable from a closed position to a first open position and axially movable from said closed position to a second open position, said stem having a passage emerging at an outlet opening, a first inlet opening, and a second inlet opening; and a peripheral portion coupled to said stem and to said sealing portion so as to define a peripheral space around said stem, said peripheral space being isolated from an interior space of said body in said closed position and being open to said interior space in said first and second open positions, wherein said first inlet opening communicates with said peripheral space in said closed position, and said second inlet opening bears against said sealing portion in said closed position.

25. The valve according to claim 24, wherein said channel emerges radially at said first and second inlet openings.

26. The valve according to claim 25, wherein said channel emerges axially at said outlet opening.

27. The valve according to claim 24, wherein said peripheral portion is annular.

28. The valve according to claim 24, wherein said peripheral portion is attached to said stem and includes a lip with an edge which reaches said sealing portion in said closed position.

29. The valve according to claim 28, wherein at least a portion of said edge does not reach said sealing portion in said first and second open positions.

30. The valve according to claim 24, wherein said second inlet opening is triangular in shape.

31. The valve according to claim 24, wherein said second inlet opening is oblong in shape.

32. The valve according to claim 24, wherein said outlet opening communicates with a dispensing head.

33. The valve according to claim 24, wherein said product is a cosmetic product.

34. The valve according to claim 24, wherein said first and second inlet openings have a same angular position on said stem.

35. The valve according to claim 24, wherein said first and second inlet openings have different angular positions on said stem.

36. The valve according to claim 24, wherein said first and second inlet openings have a same cross-section.

37. The valve according to claim 24, wherein said first and second inlet openings have different cross-sections.

38. The valve according to claim 24, wherein said passage of said stem emerges at a third inlet opening which bears against said sealing portion in said closed position.

39. The valve according to claim 38, wherein said third inlet opening is disposed axially apart from said second inlet opening.

40. The valve according to claim 39, wherein said second and third inlet openings have different angular positions on said stem.

41. A device for dispensing a product, comprising:

a body;

a sealing portion coupled to said body;

a stem coupled to said sealing portion, said stem having a passage emerging at an outlet opening, a first inlet opening, and a second inlet opening; and a dispensing head coupled to said stem, said channel emerging into said dispensing head at said outlet opening, wherein said dispensing head includes a first bearing portion at a distance from a longitudinal axis of said stem so that said stem tilts to a first open position when pressure is applied to said first bearing portion, said dispensing head including a second bearing portion through which said longitudinal axis passes so that said stem moves axially to a second open position when pressure is applied to said second bearing portion, wherein said first inlet opening does not bear against said sealing portion in a closed position, and said second inlet opening bears against said sealing portion in said closed position.

42. The device according to claim 41, further comprising a peripheral portion coupled to said sealing portion and to said stem so as to define a peripheral space around said stem, said peripheral space being isolated form an interior space of said body in said closed position and being open to said interior space in said first and second open positions.

43. The device according to claim 41, wherein said first and second bearing portions define surfaces on two different planes.

44. The device according to claim 43, wherein said surfaces defined by said first and second bearing portions are parallel to each other.

45. The device according to claim 41, wherein said channel emerges radially at said first and second inlet openings.

46. The device according to claim 41, wherein said peripheral portion is attached to said stem and includes a lip with an edge which reaches said sealing portion in said closed position.

47. The device according to claim 46, wherein at least a portion of said edge does not reach said sealing portion in said first and second open positions.

48. The device according to claim 41, wherein said product is a cosmetic product.

* * * * *